US009545555B2

(12) United States Patent
Sudeith et al.

(10) Patent No.: US 9,545,555 B2
(45) Date of Patent: Jan. 17, 2017

(54) CLIMBING WALLS

(71) Applicant: Everlast Climbing Industries, Inc., Mendota Heights, MN (US)

(72) Inventors: Timothy S. Sudeith, Edina, MN (US); Tracy L. Whitney, Chaska, MN (US); John D. Kidd, Newport, MN (US); Benjamin C. Tiffin, Missoula, MT (US)

(73) Assignee: EVERLAST CLIMBING INDUSTRIES, INC., Mendota Heights, MN (US)

( * ) Notice: Subject to any disclaimer, the term of this patent is extended or adjusted under 35 U.S.C. 154(b) by 319 days.

(21) Appl. No.: 13/839,688

(22) Filed: Mar. 15, 2013

(65) Prior Publication Data

US 2014/0106938 A1 Apr. 17, 2014

Related U.S. Application Data

(60) Provisional application No. 61/713,791, filed on Oct. 15, 2012.

(51) Int. Cl.
*A63B 21/00* (2006.01)
*A63B 69/00* (2006.01)

(52) U.S. Cl.
CPC ..... *A63B 69/0048* (2013.01); *A63B 2225/60* (2013.01); *Y10T 29/49826* (2015.01)

(58) Field of Classification Search
CPC ..... A63B 21/068
USPC ..... 482/35, 37
See application file for complete search history.

(56) References Cited

U.S. PATENT DOCUMENTS

| | | | | |
|---|---|---|---|---|
| 6,860,836 | B1 * | 3/2005 | Wu | A63B 22/001 198/850 |
| 7,762,929 | B1 * | 7/2010 | Celone | 482/49 |
| 2002/0019297 | A1 * | 2/2002 | Vettori | 482/37 |
| 2003/0228956 | A1 * | 12/2003 | Paci | 482/37 |
| 2007/0082791 | A1 * | 4/2007 | Reese et al. | 482/37 |
| 2010/0004098 | A1 * | 1/2010 | Hensley | 482/37 |
| 2011/0319230 | A1 * | 12/2011 | Brendle | 482/37 |

* cited by examiner

*Primary Examiner* — Jerome W Donnelly
(74) *Attorney, Agent, or Firm* — McAndrews, Held & Malloy, Ltd.

(57) ABSTRACT

An example climbing wall includes: a frame; a plurality of climbing panels connected to the frame; and a plurality of holds, each of the plurality of holds connected to at least one of the plurality of climbing panels with a t-nut, the t-nut including: a flange in contact with the at least one plurality of climbing panels, and a plurality of splines embedded within the at least one climbing panels.

11 Claims, 10 Drawing Sheets

CLIMBING WALLS

FIELD OF DISCLOSURE

The current application relates to climbing walls. More specifically, the current application relates to climbing walls located proximate aquatic bodies.

BACKGROUND OF THE DISCLOSURE

Climbing walls can be a good source of entertainment for all ages. Different walls provide different levels of challenges, varying in terms of handholds, pitch, etc. This makes the activity interesting and allows a participant to find satisfaction as the participant progresses in skill level. However, the opportunities to participate in the sport may be limited based upon the small number of locations having such walls for use.

SUMMARY OF THE DISCLOSURE

In one aspect, a climbing wall includes: a frame; a plurality of climbing panels connected to the frame; and a plurality of holds, each of the plurality of holds connected to at least one of the plurality of climbing panels with a t-nut, the t-nut including: a flange in contact with the at least one plurality of climbing panels, and a plurality of splines embedded within the at least one climbing panels.

In another aspect, a climbing wall includes: a frame, wherein the frame is divided into a plurality of sections connected with hinges; a plurality of climbing panels connected to the frame, wherein the plurality of climbing panels are constructed of a transparent material; and a plurality of holds, each of the plurality of holds connected to at least one of the plurality of climbing panels with a t-nut, the t-nut including: a flange in contact with the at least one plurality of climbing panels, and a plurality of splines embedded within the at least one climbing panels.

In yet another aspect, a method for creating a climbing wall comprising: constructing a frame; connecting a plurality of climbing panels to the frame; and connecting a plurality of holds to at least one of the panels, each of the plurality of holds being connected with a t-nut, the t-nut including: a flange in contact with the at least one plurality of climbing panels, and a plurality of splines embedded within the at least one climbing panels.

A more fulsome disclosure is provided below, which provides additional variations and detail to this short summary.

BRIEF DESCRIPTION OF THE FIGURES

Non-limiting and non-exhaustive embodiments are described with reference to the following figures, wherein like reference numerals refer to like parts throughout the various views unless otherwise specified.

DETAILED DISCLOSURE

Various embodiments are described more fully below with reference to the accompanying drawings, which form a part hereof, and which show specific embodiments of the invention. However, embodiments may be implemented in many different forms and should not be construed as limited to the embodiments set forth herein; rather, these embodiments are provided so that this disclosure will be thorough and complete, and will fully convey the scope of the invention to those skilled in the art. Therefore, the following detailed description is not to be taken in a limiting sense.

Figure 10:
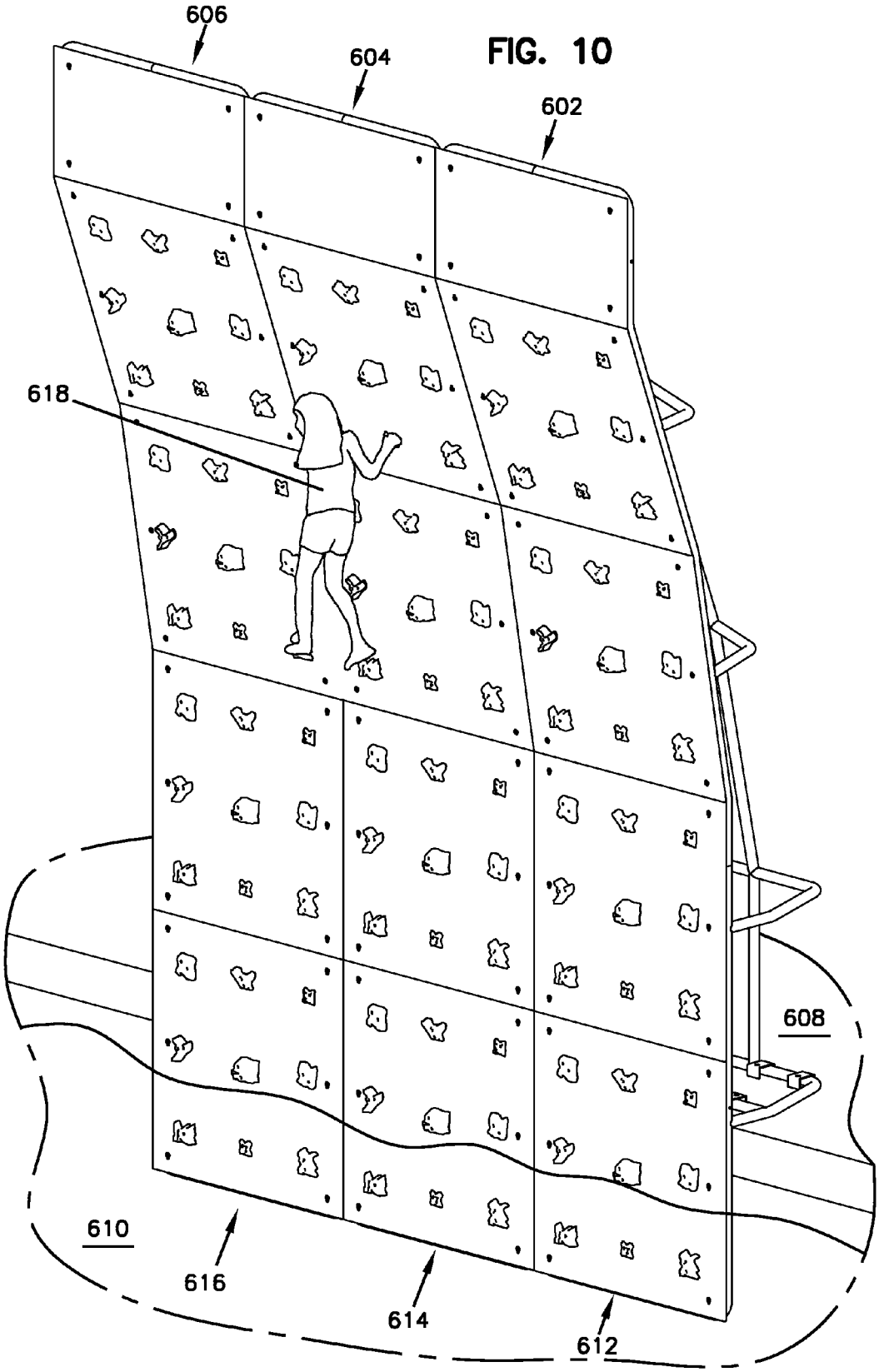
FIG. 10 is a perspective view of an example of a climbing wall installed at a pool.

The present application discloses a climbing wall. The climbing wall includes a frame, a plurality of climbing panels, and a plurality of holds. The plurality of climbing panels is connected to the frame and constructed of a transparent material. The plurality of holds is connected to at least one of the plurality of climbing panels with a t-nut. The t-nut includes a flange and a plurality of splines. The flange is in contact with the at least one of the plurality of climbing panels. The plurality of splines are embedded within the at least one climbing panel. The climbing wall may be secured to a surface such as, for example, a poolside deck, a boat deck, a pier, etc. See FIG. 10.

Figure 1:
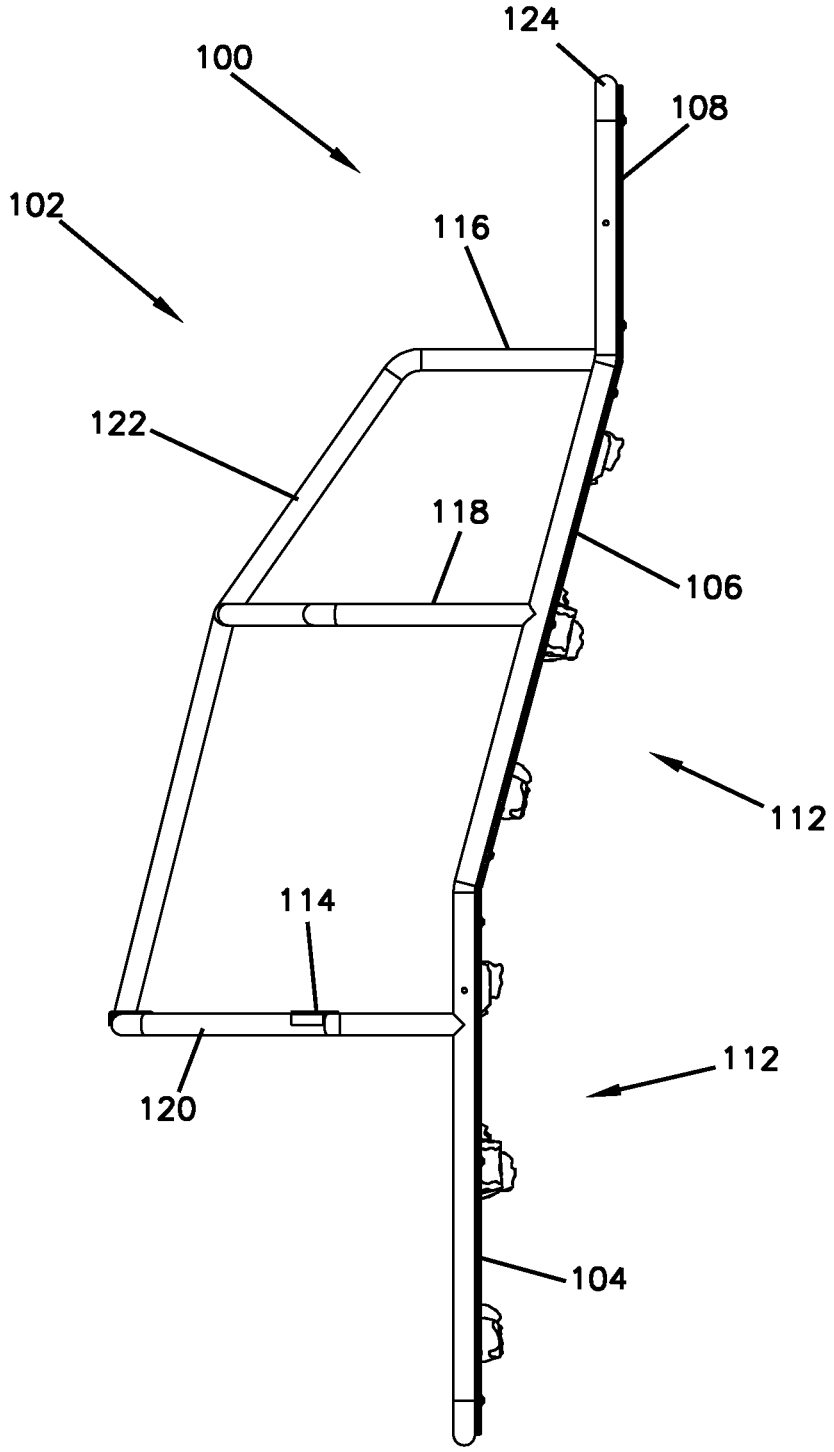
FIG. 1 is a side view of an example climbing wall having two climbing panels.
Figure 2:
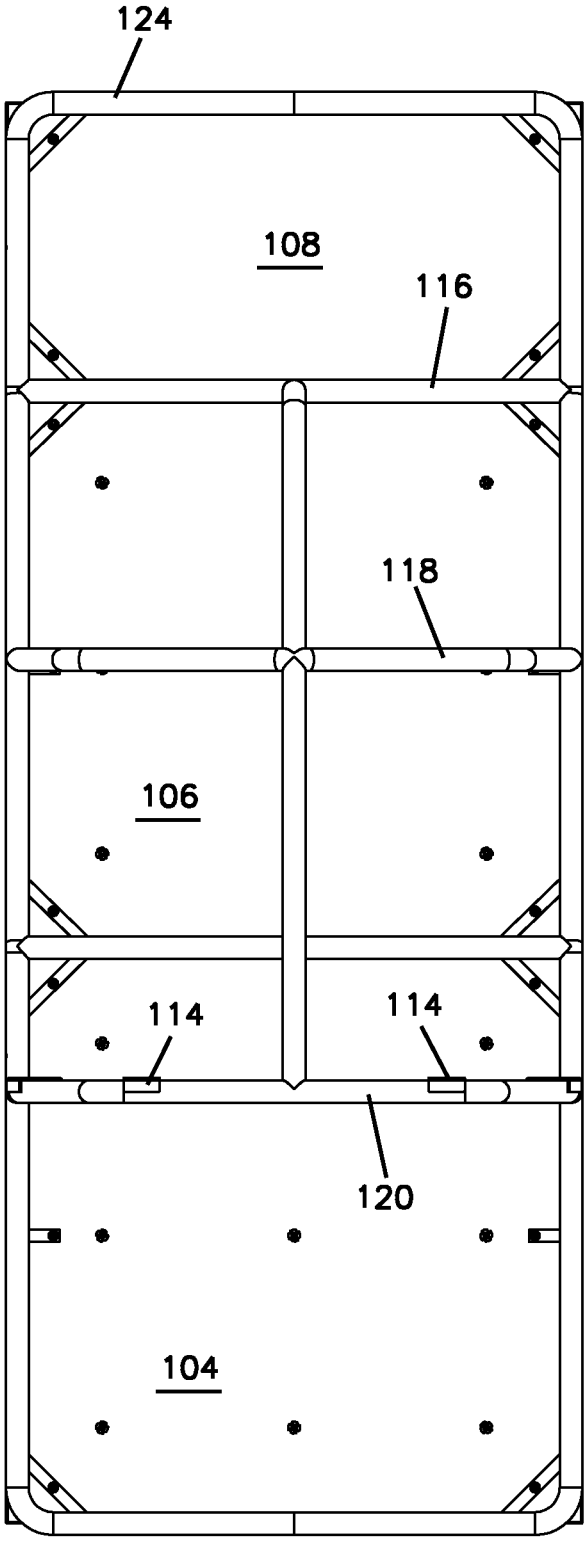
FIG. 2 is a front view of the climbing wall of FIG. 1.
Figure 3:
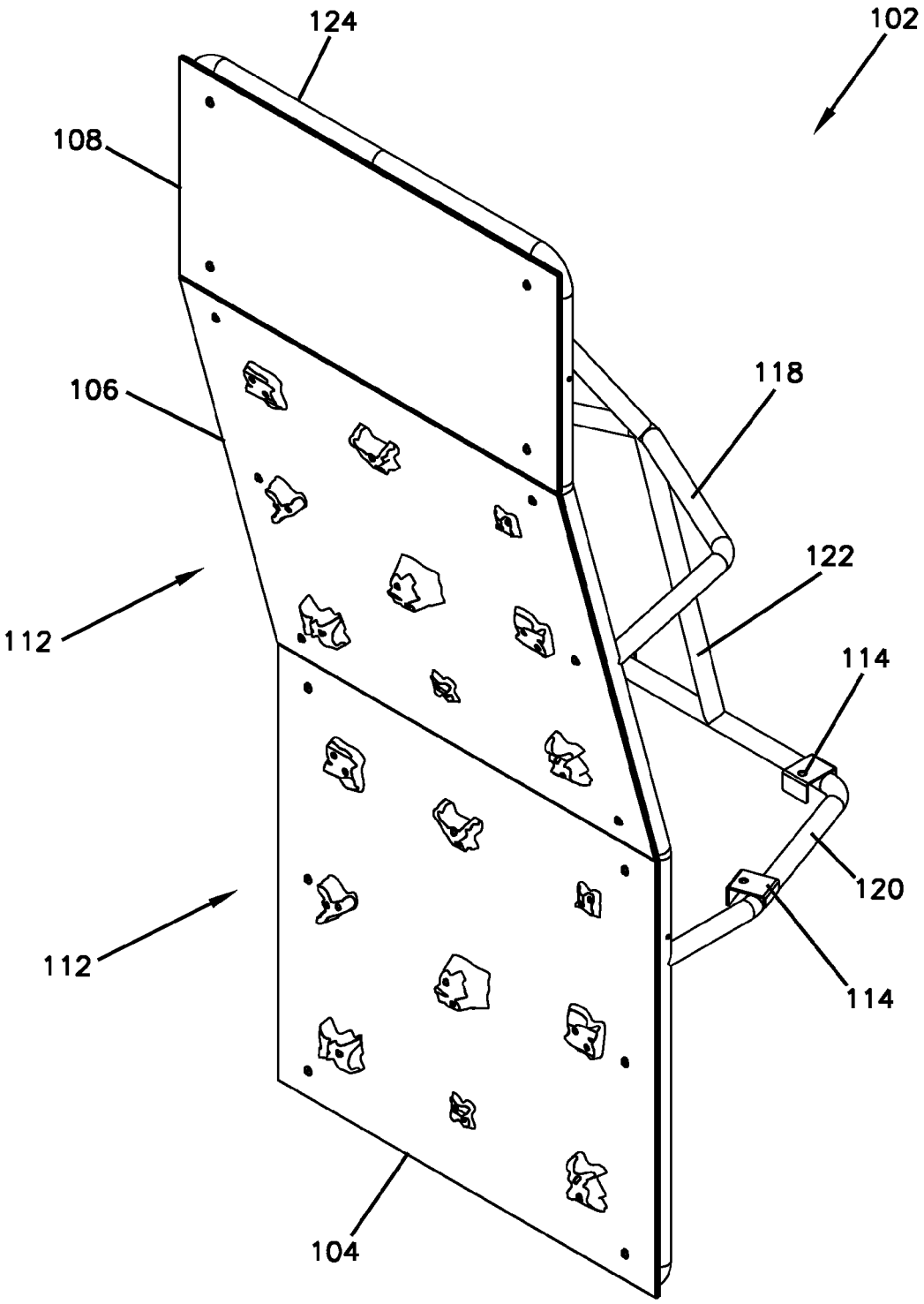
FIG. 3 is a perspective view of the climbing wall of FIG. 1.

Turning now to the figures, FIGS. 1-3 show a climbing wall 100. The climbing wall 100 includes a frame 102, a first climbing panel 104, a second climbing panel 106, and a safety panel 108. The first climbing panel 104 and the second climbing panel 106 each include a plurality of climbing holds 112. While FIGS. 1-3 show the first climbing panel 104 and the second climbing panel 106 each having nine climbing holds, climbing panels may include any number of climbing holds. For example, to increase the difficulty level in climbing the climbing wall 100, fewer climbing holds may be installed or more difficult climbing holds may be used, such as those that are harder to hold. To decrease the difficulty level in climbing the climbing wall 100, more climbing holds may be installed or easier climbing holds may be used, such as those that are larger or easier to hold.

FIGS. 1-3 shows the plurality of climbing holds 112 arranged in a 3×3 pattern on each climbing panel. The plurality of climbing holds 112 may be arranged in any pattern, or may be arranged in no discernible pattern (i.e., randomly). In addition, the plurality of holds 112 may include holds of differing colors. For example, some holds may be red, some may be blue, etc. The different colors may be used to define climbing routes and/or routes of different difficulty. For instance, one route by be defined using red holds, a second route using blue holds, and a third route using yellow holds. The red route may be the most difficult route, while the yellow route may be the easiest route. The routes difficulty may be due to the spacing between the hold and/or the size of the holds. For example, a difficult route may be created using holds that are small and spaced farther apart than a climber may comfortably reach. An easy route may be created using holds that are large and spaced relatively close together.

In this example, the first climbing panel 104, the second climbing panel 106, and the safety panel 108 are constructed of a clear or semi-opaque polymer. A non-limiting example of a clear polymer is a polycarbonate. Constructing the various panels from a clear polymer may act to minimize blind spots. This allows individuals to easily view activities positioned behind the climbing wall. In other examples, the climbing wall can be semi- or completely opaque.

In addition, the panels may be coated to provide UV protection. For example, the panels may be coated with a coating that blocks UV rays. Further, the panels can be coated with other materials, such as material that resists scratching of the surfaces of the panels during use.

The frame 102 may be constructed of a polymer or metallic tubing. For example, the frame 102 may be constructed of stainless steel tubing, round or square. In addition, the frame 102 may be modular. For instance, the frame 102 may be constructed of individual pieces that an end user (e.g., a pool owner) may assemble onsite. For example, the frame 102 may be constructed of a first u-shaped rib 116, a second u-shaped rib 118, and a third u-shaped rib 120. The u-shaped ribs may be connected to each other with a spine 122 and a square frame 124.

The first climbing panel 104, the second climbing panel 106, and the safety panel 108 may be bolted to square frame 124. In example embodiments, the bolts are placed at least in each corner of the panels 104, 106, 108 to affix the panels to the square frame 124. In other examples, additional bolts are placed at points between the corners of each panel (e.g., at a midpoint or other points there along) to bolster the connection therebetween. In such a configuration, any bowing of the midsections of the panels can be minimized.

The u-shaped ribs, the spine 122, and the square frame 124 may be bolted to one another. The frame 102 may also be constructed as a single piece at a factory and shipped to the end user. In yet another example, the frame 102 can be configured to fold in upon itself, such as using hinges or similar structures, to minimize the size of the frame 102 during shipping. Other configurations are possible.

The frame 102 may also be configured to collapse for storage. For instance, the frame 102 may include hinges located at the intersections of the first climbing panel 104 and the second climbing panel 106. The hinges may allow the climbing wall 100 to fold. In a folded state, the plurality of holds 112 may not be reachable. Folding the climbing wall 100 may increase safety by not allowing children or other unauthorized users from using it. In addition, folding the climbing wall 100 may allow it to be stored using minimal space. For example, during winter or other times when a pool may be closed, the climbing wall 100 may be removed from a pool deck, folded, and stored offsite.

The frame 102 may be secured to a surface, such as, a pool deck, a pier, a boat dock, a boat deck, etc., using a plurality of brackets 114. The plurality of brackets 114 may be secured to the surface permanently or they may be removable. For example, the plurality of brackets 114 may be bolted to the surface. The bolts may be removed and the climbing wall 100 may be unsecured from the surface and removed. In addition, the frame 102 may be disassembled when the climbing wall 100 is stored for long periods of time (e.g., winter).

The frame 102 can be bolted to the deck using a variety of methods. In one method, the frame 102 is placed upon the deck, and bolts are placed through the frame and into the deck to affix the frame 102 to the deck. In another example, the bolts can first be affixed to the deck so that the bolts extend upward away from the deck. The frame 102 can thereupon be placed on the bolts (e.g., by lining up the bolts with holes formed in the frame 102) and affixed thereto. Other configurations are possible.

Figure 4:
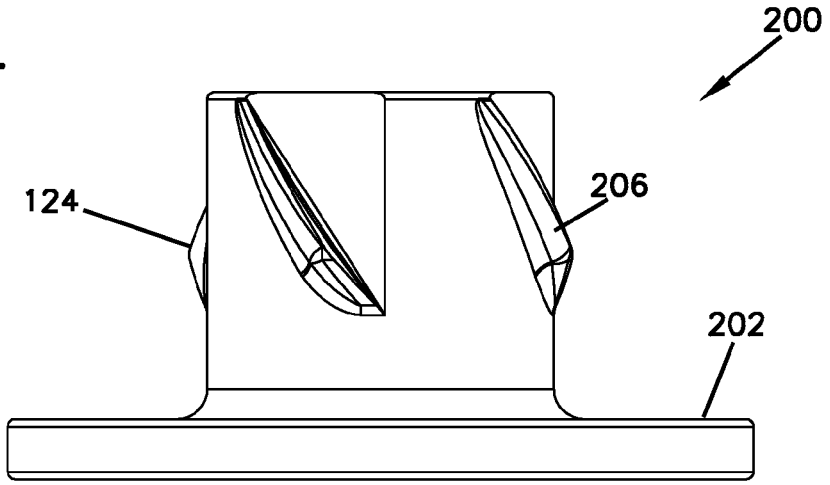
FIG. 4 is a side view of an example t-nut.
Figure 5:
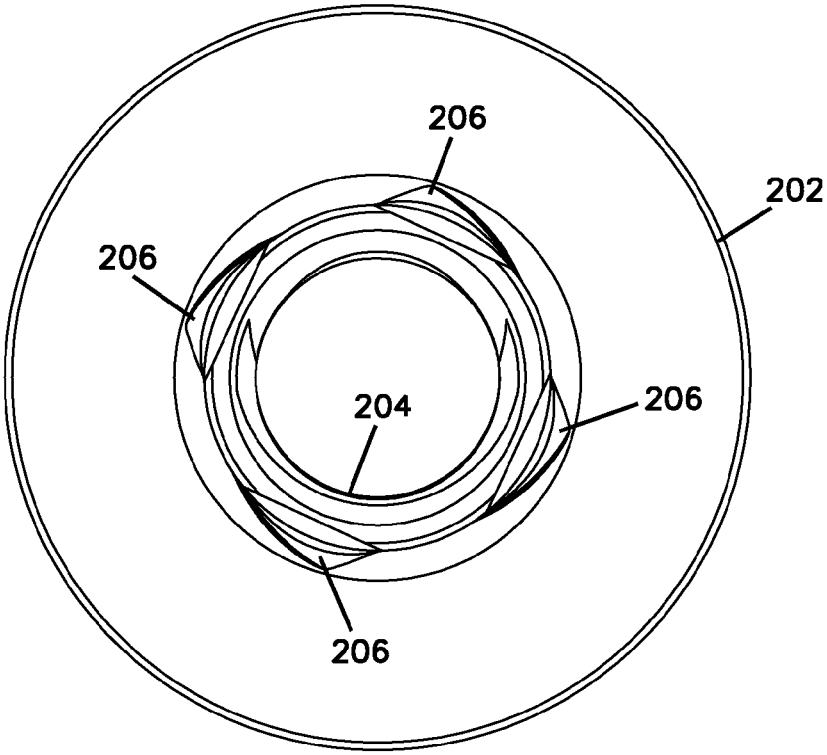
FIG. 5 is a top view of the t-nut of FIG. 4.
Figure 6:
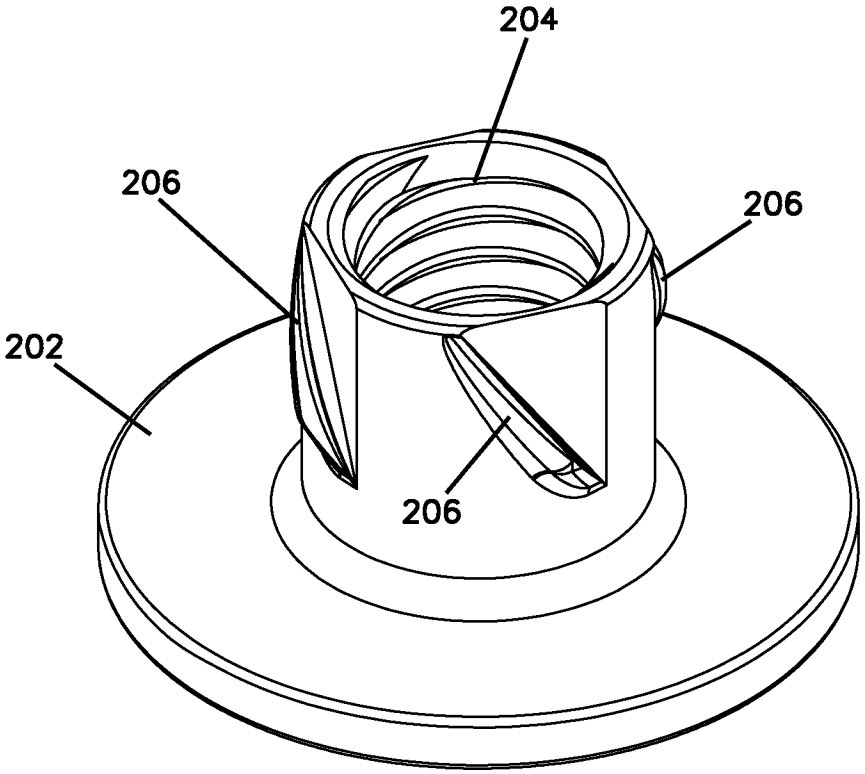
FIG. 6 is a perspective view of the t-nut of FIG. 4.

The plurality of holds 112 may be bolted to the first climbing panel 104 and the second climbing panel 106. For example, a bolt may pass through a hold and a climbing panel and engage a t-nut 200 (see FIGS. 4-6) located on the backside of the climbing panel. The t-nut 200 includes a flange 202, female threads 204, and a plurality of splines 206. During installation of the plurality of holds 112, the flange 202 may mate with the backside of the respective climbing panel. As the bolt is tightened, the plurality of splines 206 may penetrate the climbing panel. Friction created between the plurality of splines 206 and the climbing panels may help to prevent the t-nut 200 from rotating and allow the hold to be properly tightened. For instance, a user may be installing one of the plurality of holds 112 into the first climbing panel 104 upon purchasing the climbing wall 100. While installing the hold, the user may pass a bolt through the hold and the first climbing panel 104. The bolt may connect with the t-nut 200. As the user tightens the bolt, the plurality of protrusions 206 may cut grooves into the first climbing panel 104, thereby locking the t-nut 200 into place.

Figure 11:
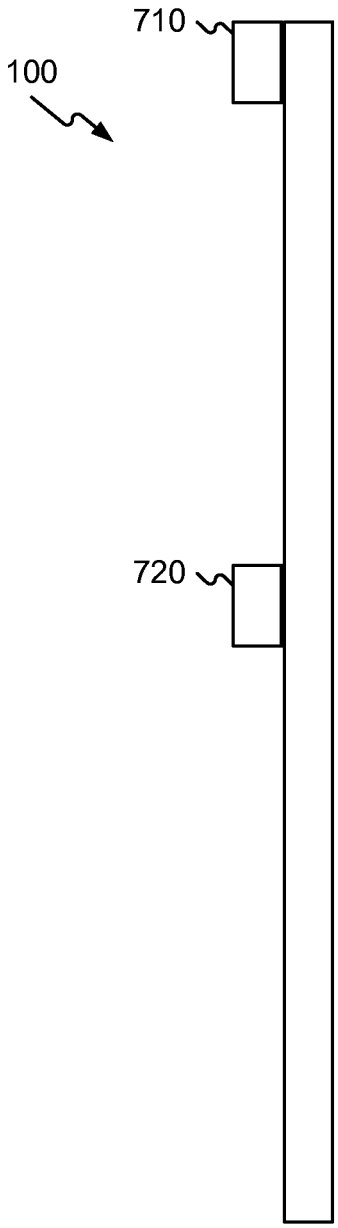
FIG. 11 is a schematic view of an example climbing wall having various features.

Water jets may be installed at various locations along the climbing wall 100, such as at one or both of modules 710, 720 (see FIG. 11). The water jets may be connected to the pool's pump system or connected to pumps independent of the pool's pump system. The water jets may include electronically controlled valves. The electronically controlled valves may be connected to a controller. The controller may actuate the valves at random times. The random actuation may increase user enjoyment and climbing difficulty. For example, the water may increase the difficulty in grasping the plurality of holds 112. The water may also spray climbers in the face or stomach to increase the climbers' enjoyment. In addition to water spraying from jets, water may cascade down the climbing wall 100.

A timing system may be connected to the climbing wall 100. For example, as shown in FIG. 11, module 710 including a buzzer and display may be located at the top of the climbing wall 100. The display may count down from a preset time and sound the buzzer if the user does not reach the top of the climbing wall 100. Furthermore, the display may act as a stopwatch and may count up from zero. The user may stop the time by pressing a button located at the top of the climbing wall 100. The timing system may allow climbers to race each other for the best time, or allow a climber to monitor his or her climbing times over a period of time to track climbing improvements. Examples of such timing device switches include those described in U.S. Pat. No. 3,920,940 and US Patent Published Application No. 2009/0185455, the entireties of which are hereby incorporated by reference.

Figure 7:
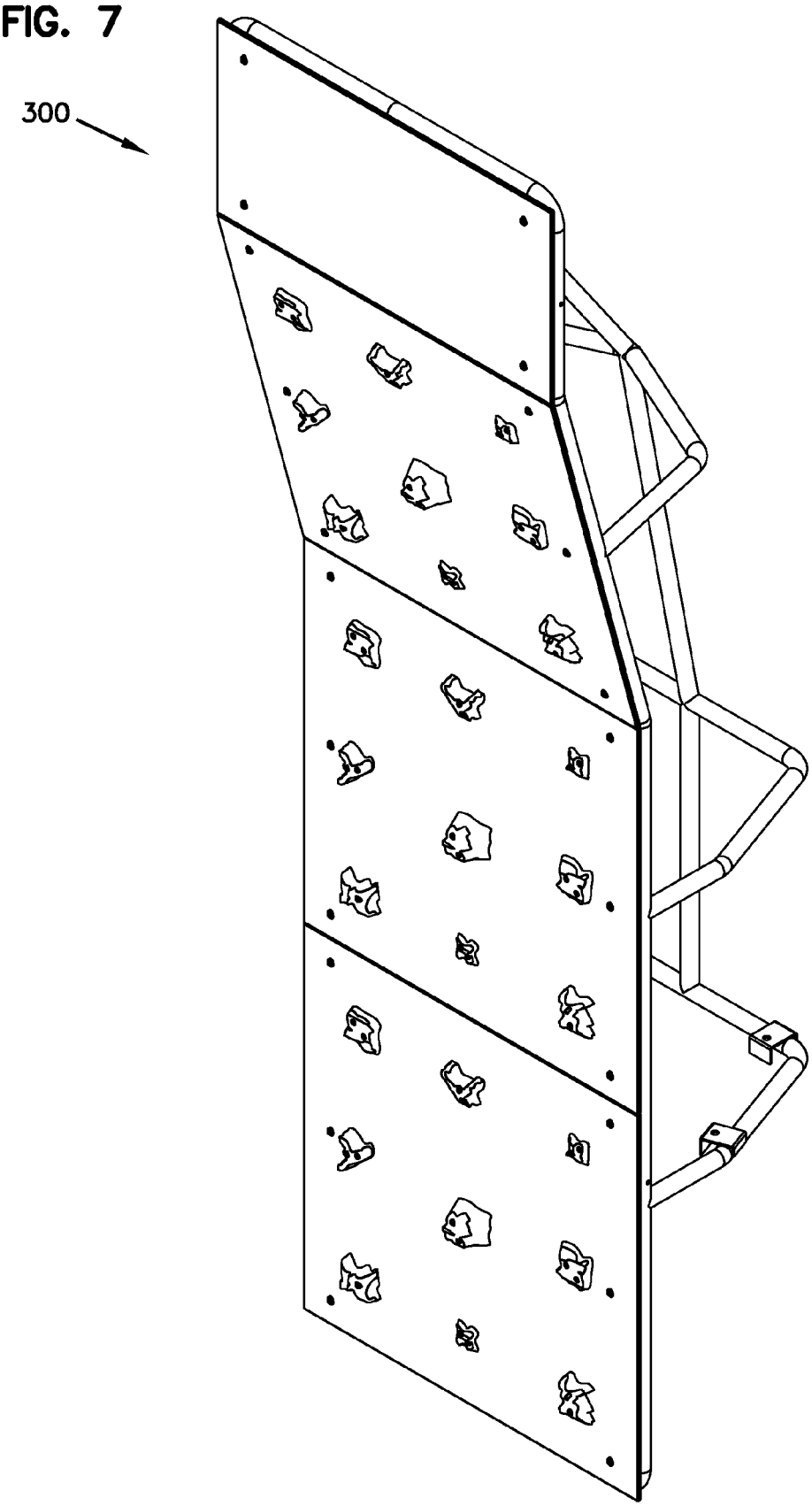
FIG. 7 is a perspective view of an example climbing wall having three climbing panels.
Figure 8:
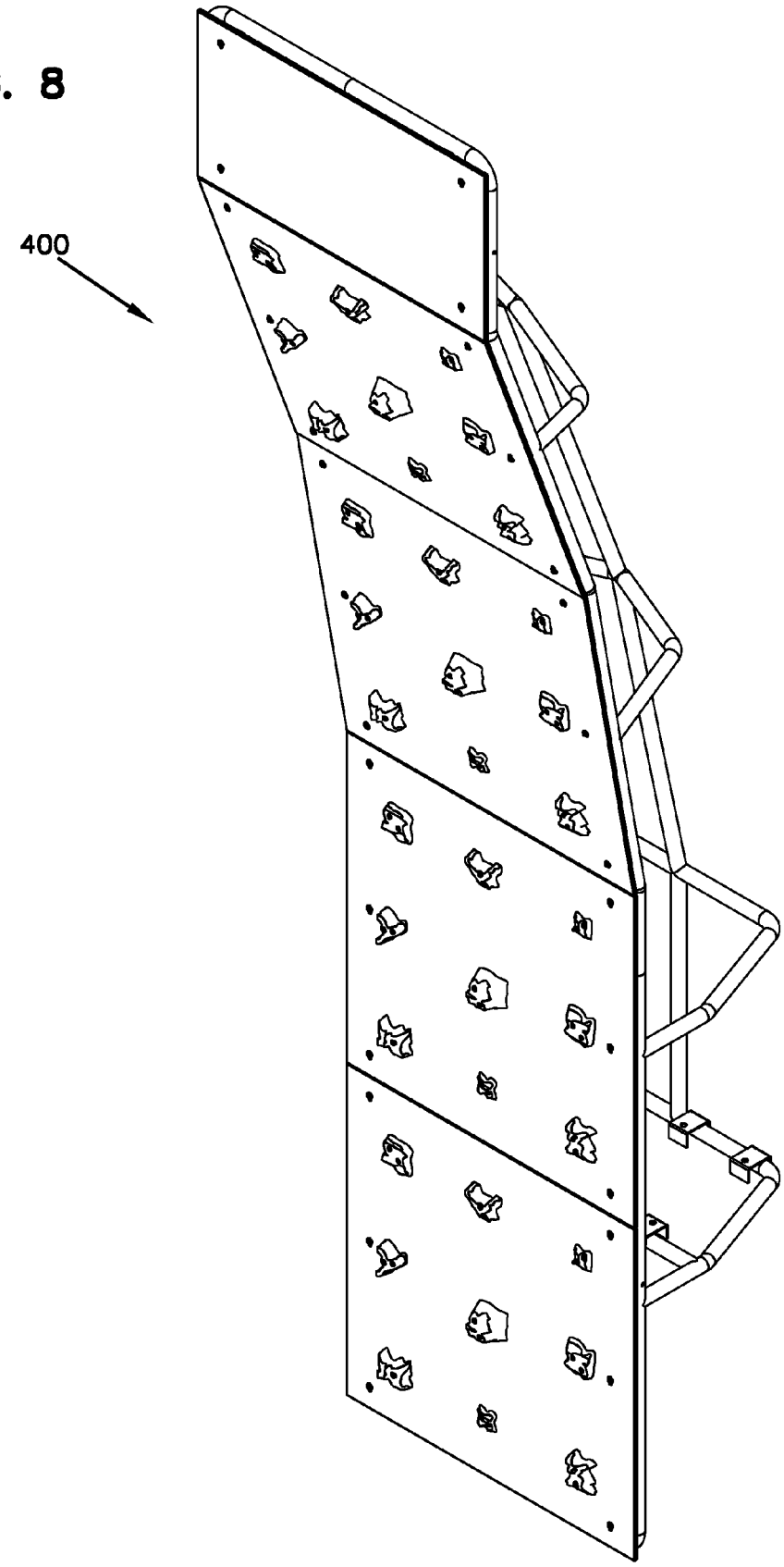
FIG. 8 is a perspective view of an example climbing wall having four climbing panels.

While FIGS. 1-3 show a climbing wall having two climbing panels, a climbing wall may have more than two climbing panels. For example, FIG. 7 shows a climbing wall 300 having three climbing panels. FIG. 8 shows a climbing wall 400 having four climbing panels. In addition, the climbing wall may extend from one side of a pool to another side of the pool. For instance, the climbing wall may form an arch across the pool. A climber may then be able to climb across the arch. Should the climber fall, he or she would fall into the pool. Regardless of the number of climbing panels, and/or the shape of the climbing wall, the climbing wall may be constructed in a similar fashion as the climbing wall 100 shown in FIGS. 1-3.

In alternative example embodiments, the climbing panels 506 and 504 can be in the same plane or the two climbing panels 506 and 504 can form an angle ranging from about 0 degrees to 180 degrees. For example the climbing panels 506 and 504 may be placed at the corner of a pool forming approximately a 90 degree angle. In other example embodiments, the climbing panels 506, 504, and 502 may be at different angles relative to one another. In yet another example embodiment, the climbing panels depicted in FIG. 9 may be configured such that the two outside climbing panels 506 and 502 each forms angles ranging from approximately 90 degrees to approximately 180 degrees relative to the adjacent climbing panel.

Figure 9:
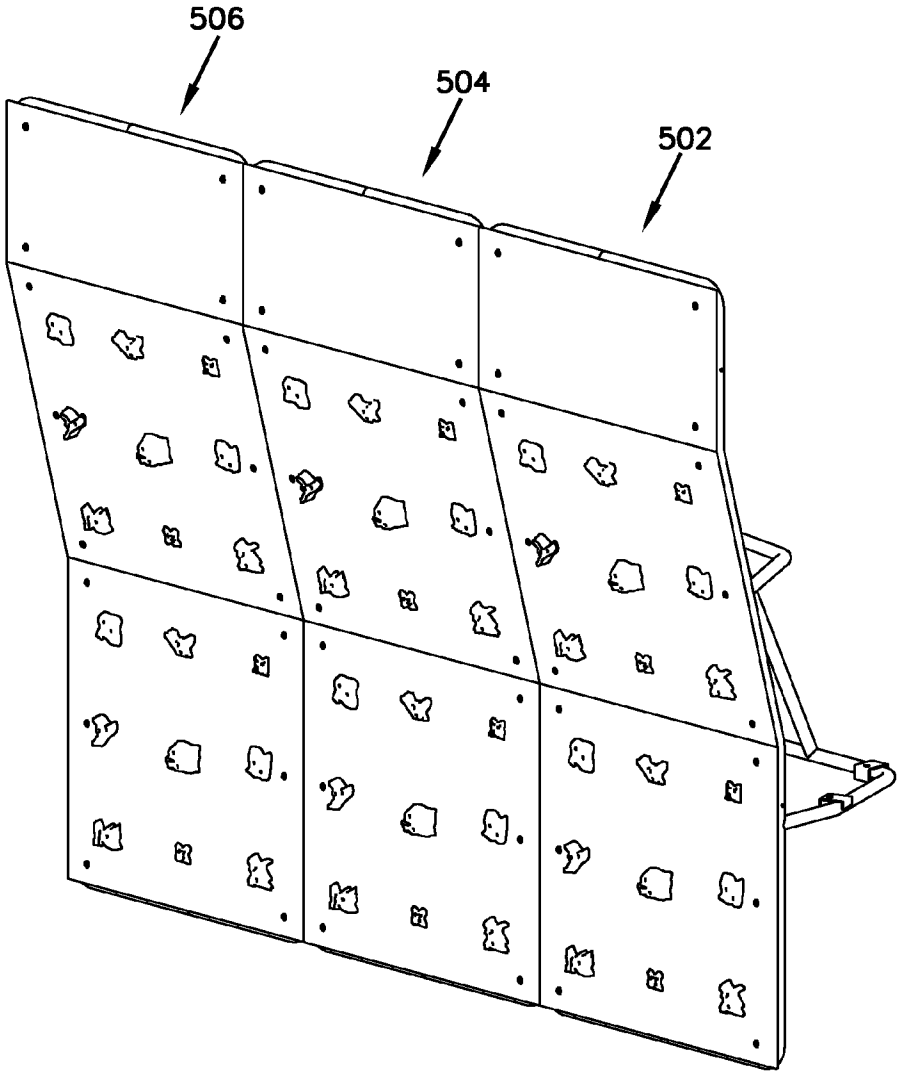
FIG. 9 is a perspective view of an example climbing wall having multiple portions.

FIG. 9 shows three climbing walls 602, 604, and 606 attached to a deck 608 beside a pool 610 and arranged in a side-by-side manner. As shown in FIG. 9, a portion of first climbing panels 612, 614, and 616 may be partially submerged in pool 610. During use, a climber 618 may swim to one of climbing walls 602, 604, and 606. After reaching one of climbing walls 602, 604, and 606, climber 618 may begin traversing one of climbing walls 602, 604, and 606. Upon reaching the top of one of climbing walls 602, 604, and 606, climber 618 may climb down climbing walls 602, 604, and 606 or may dive back into pool 610.

In other examples, features mounted to the climbing wall and/or the climbing wall itself can function to provide shade to the surroundings. For example, a shade or other similar device can be mounted to a backside of the climbing wall to provide shade to individuals seeking to stay out of the direct sunlight. Many configurations are possible.

While FIGS. 1-3 and 7-9 show climbing walls with fixed inclinations, actuators may be used to allow the climbing wall's inclination to be changed. For example, a standard configuration may be a near vertical climbing wall. In other words, the climbing wall may have a slight tilt toward the water. The slight tilt may help prevent a climber from striking the climbing wall should the climber fall. However, actuators may be used to further increase the inclination so that the climbing wall tilts toward the water. For instance, having the climbing wall tilted more towards the water increases the climbing difficulty because the climber has to support more of his or her weight with his or her upper body, therefore, a climber wanting a more strenuous climb may want the climbing wall to be tilted more towards the water.

In addition to a climbing wall having one column of climbing panels, multiple columns of climbing panels may be placed proximate each other as shown in FIG. 9. For example, a first column of climbing panels 502 may be located beside a second column of climbing panels 504. A third column of climbing panels 506 may be located beside the second column of climbing panels 504.

In addition to being installed on the side of a pool, climbing walls may be installed within the pool. For example, four climbing walls may be placed back-to-back in the center of the pool to form a four-sided climbing tower. Any number of climbing walls may be used to form a climbing tower. For instance, three climbing walls may be used to form a triangular climbing tower, six climbing walls may be used to form a hexagonal climbing tower, etc. In other embodiments, the climbing wall may simply be one wall with hand holds on each of the front and back of the climbing wall allowing climbers to use both side of the wall as disclosed in U.S. Pat. No. 7,520,837, which is incorporated herein by reference. The climbing tower may be affixed to the bottom of the pool. The climbing tower does not have to be affixed to the pool. The climbing tower may float. A floating climbing tower may increase climbing difficulty because as the climber climbs, the tower may shift and possibly cause the climber's weight to shift and a loss of balance.

A zip line may extend from the top of a climbing tower or a climbing wall, such as at the module 710. After a climber climbs to the top of a climbing wall, he or she may zip line down into the pool. In other examples, a module 720 located along the climbing wall 100 can include a landing onto which a climber can perch. The landing can be used so that the climber can rest. In other examples, the climber can use the landing to dive back into the pool and/or to access a rope swing to swing back into the pool. Other configurations are possible.

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Moreover, use of the term "and" when incorporated into a list is intended to imply that all the elements of the list, a single item of the list, or any combination of items in the list has been contemplated.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

The above specification, examples, and data provide a description of the manufacture, operation and use of the invention. Since many embodiments of the invention can be made without departing from the spirit and scope of the invention, the invention resides in the claims hereinafter appended.

What is claimed is:

1. A climbing wall comprising:

a frame, a portion of which is secured to an upward-facing surface;

a plurality of climbing panels connected to the frame, the plurality of climbing panels comprising at least a first climbing panel and a second climbing panel, the first climbing panel extending vertically below the upward-facing surface to which the frame is secured; and a plurality of holds, each of the plurality of holds connected to one of the plurality of climbing panels;

wherein the frame is divided into a plurality of sections, and wherein the frame includes one or more hinges located at the intersection of the first climbing panel and the second climbing panel, the first climbing panel being foldable to render the plurality of holds connected to at least the first climbing panel inaccessible.

2. The climbing wall of claim 1, wherein the plurality of climbing panels are constructed of a transparent material.

3. The climbing wall of claim 1, further comprising a timing system.

4. The climbing wall of claim 1, further comprising at least one water jet, the water jet arranged to direct a stream of water toward a climber.

5. The climbing wall of claim 1, further comprising a zip line connected to a top of the frame.

6. The climbing wall of claim 1, further comprising at least one actuator arranged to adjust an inclination angle of the climbing wall.

7. The climbing wall of claim 1, wherein the plurality of holds comprise holds of differing colors, wherein holds of a single color represent a difficulty level.

8. The climbing wall of claim 1, wherein the plurality of climbing panels are coated with a UV protective coating.

9. The climbing wall of claim 1, wherein one or more of the plurality of climbing panels is coated with a scratch-resistant material.

10. The climbing wall of claim 1, wherein the upward-facing surface is a pool deck.

11. The climbing wall of claim 10, wherein at least a portion of the first climbing panel is submerged in the pool.

* * * * *